US006471499B1

(12) United States Patent
Sun

(10) Patent No.: US 6,471,499 B1
(45) Date of Patent: Oct. 29, 2002

(54) SCROLL COMPRESSOR WITH LUBRICATION DIRECTED TO DRIVE FLAT SURFACES

(75) Inventor: Zili Sun, Arkadelphia, AR (US)

(73) Assignee: Scroll Technologies, Arkadelphia, AR (US)

( * ) Notice: Subject to any disclaimer, the term of this patent is extended or adjusted under 35 U.S.C. 154(b) by 0 days.

(21) Appl. No.: 09/947,042

(22) Filed: Sep. 6, 2001

(51) Int. Cl.[7] ..... F04C 18/04; F04C 29/02
(52) U.S. Cl. ..... 418/55.5; 418/55.6
(58) Field of Search ..... 418/55.5, 55.6, 418/57

(56) References Cited

U.S. PATENT DOCUMENTS 4,836,758 A * 6/1989 Elson et al. ..... 418/55.5
5,197,868 A * 3/1993 Caillat et al. ..... 418/55.5
6,012,911 A * 1/2000 Hirooka et al. ..... 418/55.5

FOREIGN PATENT DOCUMENTS

JP 3-175188 * 7/1991

* cited by examiner

*Primary Examiner*—John J. Vrablik
(74) *Attorney, Agent, or Firm*—Carlson, Gaskey & Olds

(57) ABSTRACT

An improved method of providing lubricant to a drive flat interface between the eccentric pin and the slider block in a scroll compressor includes a notch for delivering the lubricant into the slider block bore. The notch preferably extends at a remote end of the slider block from the orbiting scroll. The notch communicates lubricant from a lubricant reservoir formed between a crankcase and the orbiting scroll boss. Further, the drive flat on the eccentric pin is preferably provided with a chamfer such that lubricant exiting the notch collects in a reservoir. The chamfer ensures that lubricant will be driven along the interface surface by ensuring that centrifugal forces will drive the lubricant only in one direction along the interface surface. In an alternative embodiment, the eccentric pin is simply constructed to provide this same feature.

13 Claims, 3 Drawing Sheets

SCROLL COMPRESSOR WITH LUBRICATION DIRECTED TO DRIVE FLAT SURFACES

BACKGROUND OF THE INVENTION

This invention relates to the provision of lubricant to the drive flat interface in a scroll compressor.

Scroll compressors are becoming widely utilized in refrigerant compression applications. In a scroll compressor, a first scroll member has a base and a generally spiral wrap extending from its base. A second scroll member has a base and a generally spiral wrap extending from its base. The wraps of the two scrolls interfit to define compression chambers. The second scroll member is caused to orbit relative to the first, and as the two orbit relative to each other, the size of the compression chambers decreases, compressing an entrapped refrigerant.

In one common type of scroll compressor, the orbiting movement of the second scroll member is caused by a rotating shaft having an eccentric pin. The eccentric pin interfits into a slider block, which is in turn received in a boss extending downwardly from the second scroll member. As the shaft rotates, its eccentric pin drives the slider block, and ultimately results in orbital movement of the second scroll member.

Typically, the eccentric pin has a drive flat surface which engages a mating flat surface in the slider block. For purposes of this application, the term "flat" should be understood to be generally flat. Preferably, a slight barrel shape is actually included into either of the two surfaces.

Applicant has seen slider blocks utilized in competitive scroll compressors that have a small notch adjacent a lower end. However, this small notch is not provided with structure between the slider block and the eccentric pin to assist in driving the lubricant along an interface surface between the two. As such, it would appear that the small notch would provide little if any lubrication benefit.

The components of scroll compressors, and in particular, the drive components, are desirably provided with lubricant during operation. However, one area that has been difficult to lubricate is this drive flat interface.

SUMMARY OF THE INVENTION

In the disclosed embodiment of this invention, a lubricant groove supplies a lubricant to the drive flat interface between a slider block and an eccentric pin in a scroll compressor. More particularly, a port is formed through the slider block to deliver lubricant from an area outwardly of the slider block to the internal bore of the slider block. The port is most preferably formed at a lower end of the slider block, and delivers the lubricant to a location in the bore in the slider block directly adjacent to the drive flat interface. There is structure between the slider block and the eccentric pin to assist in driving the lubricant from the notch along the interface surface. As will be explained in greater detail below, the contact surface between the slider block and the eccentric pin is made to be entirely on one side of an extension of a center point of the shaft perpendicular to the drive flat on the slider block. In this way, centrifugal forces will not block the flow of lubricant along the slider block pin interface. In one embodiment, this change is provided by the eccentric pin having a chamfered surface formed adjacent to its drive flat, and positioned adjacent to the outlet side of the lubricant notch. The chamfer ensures the entire contact between the drive flats will be on one side of the extension of the center point, and thus centrifugal force will drive the lubricant along that contact surface, and not block the flow.

In another embodiment, the eccentric pin could simply be shaped such that the entire contact will be on one side. One skilled in the design of scroll compressors would recognize that other trade-offs may come with such a design.

In this way, the chamfer provides a small reservoir such that lubricant exiting the port will gather and move to the drive flat interface.

These and other features of the present invention can be best understood from the following specification and drawings, the following of which is a brief description.

DETAILED DESCRIPTION OF A PREFERRED EMBODIMENT

Figure 1:
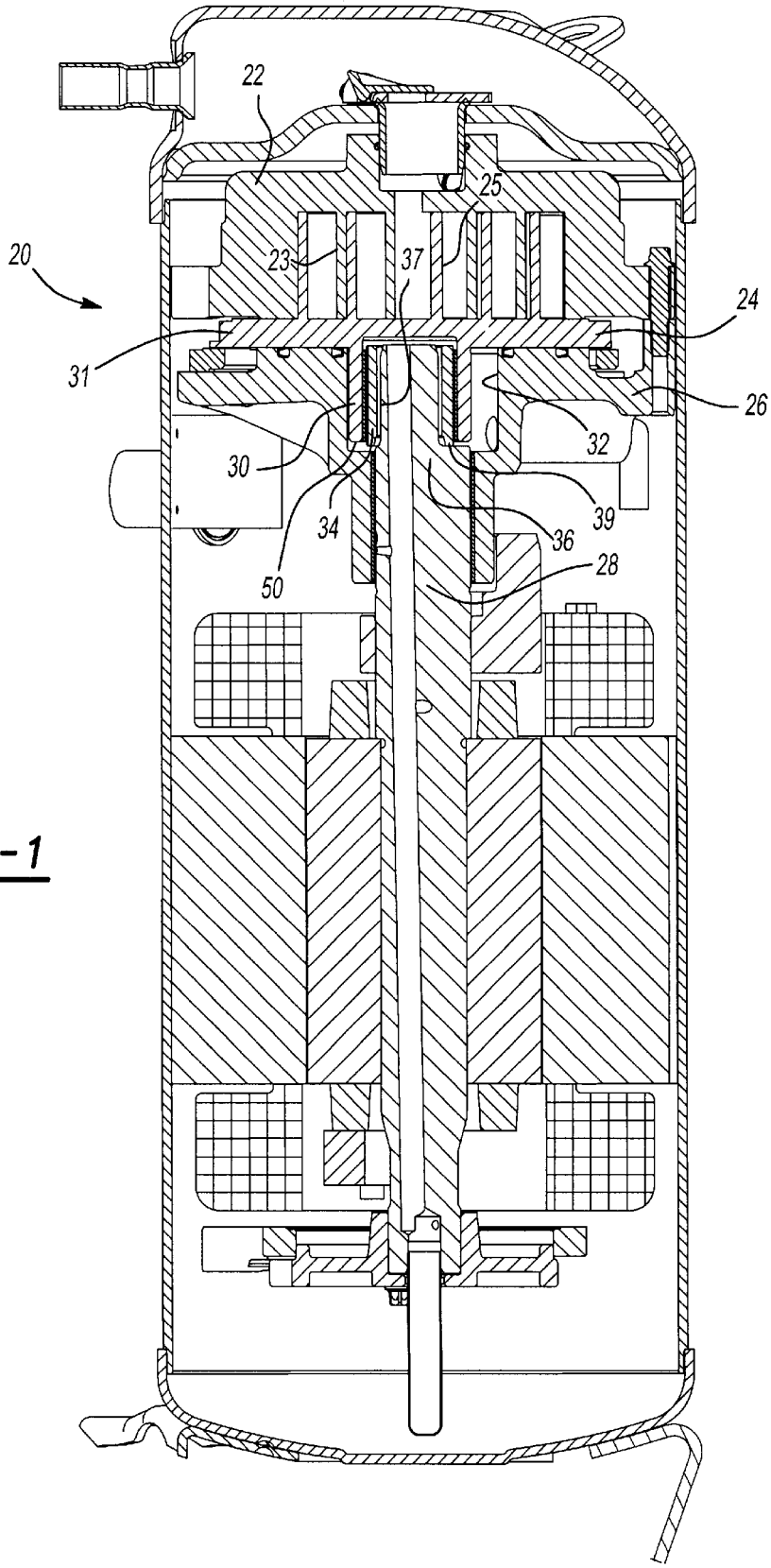
FIG. 1 shows a scroll compressor.

A scroll compressor 20 is illustrated in FIG. 1. As is known, a non-orbiting scroll 22 has wraps 23 interfitting with wraps 25 on an orbiting scroll 24. A crankcase 26 supports the orbiting scroll. A drive shaft 28 is driven by a motor to rotate. A boss 30 extends downwardly from a base 31 of the orbiting scroll 24. A slider block 34 is positioned within the boss 30. An eccentric pin 36 extends upwardly into a bore 37 in the slider block. As is known, when the shaft 28 rotates, the interaction of the eccentric pin 36 and slider block 34 cause orbiting movement of the orbiting scroll 24.

As can also be seen, there is a reservoir 32 containing a lubricant outwardly of the boss 30. As can also be seen, the slider block 34 has a lower end 39, extending beneath the end 50 of the boss 30.

Figure 2:
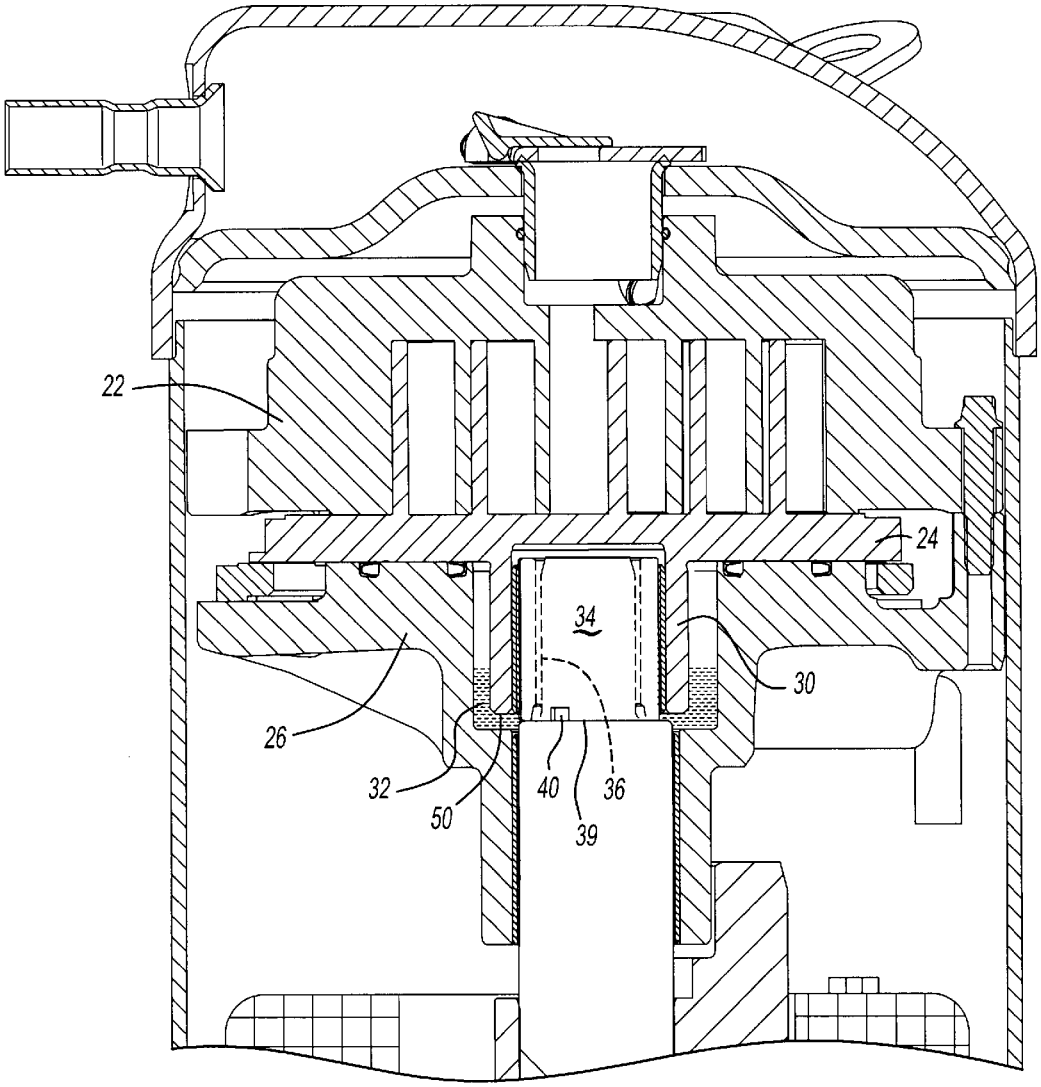
FIG. 2 is an enlarged view of one portion of the scroll compressor as shown in FIG. 1.

As can be appreciated from FIG. 2, a notch 40 is formed in the lower end 39 of the slider block 34, and at a location such that it will communicate with the reservoir 32.

Figure 3:
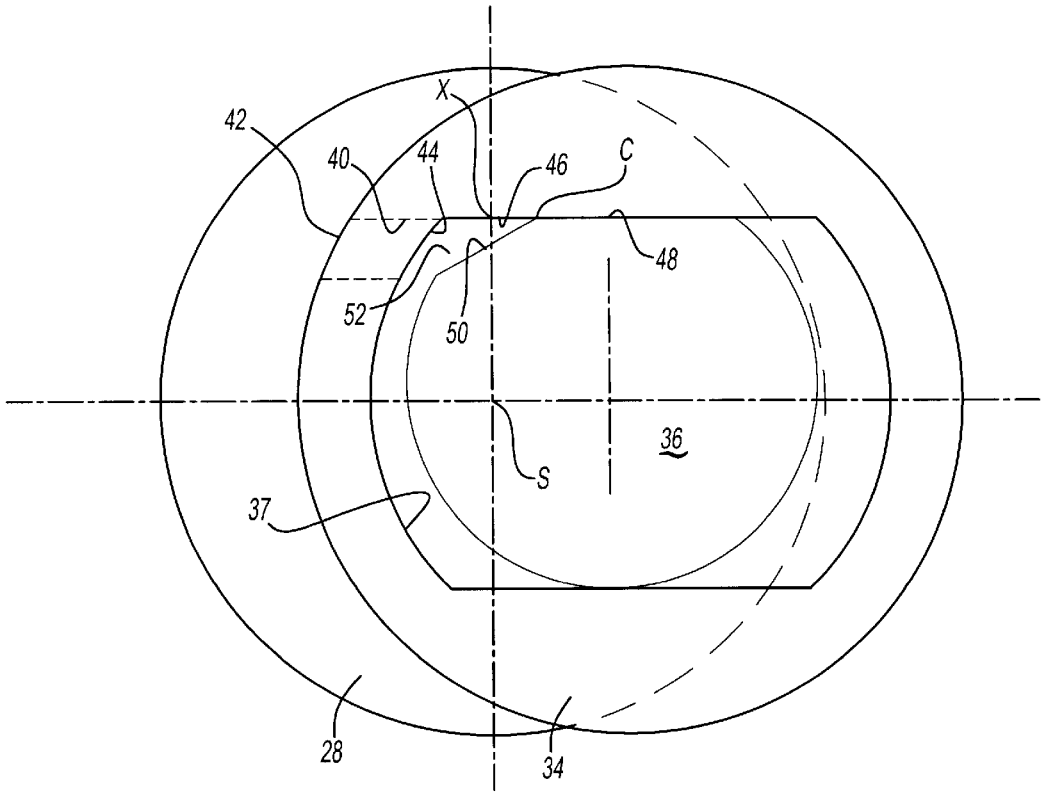
FIG. 3 is a cross-sectional view through the drive surfaces in the inventive scroll compressor.

As shown in FIG. 3, the notch 40 extends from an inlet end 42 adjacent its radially outer end to an outlet end 44 which empties into the bore 37. A drive flat 46 is formed within the bore 37 and a drive flat 48 is formed on the eccentric pin 36. A chamfer 50 is formed at an edge of the drive flat 48 which is adjacent to the outlet 44 of the notch 40. In this way, a small reservoir 52 will be created for receiving the lubricant from the notch 40, and delivering it along the drive flat interface.

As can be appreciated from FIG. 3, the shaft center point S could be described as having a point of extension X defined by a radius drawn perpendicular to the flat surface 46, or drawn as a radius to be perpendicular to the extension of the flat surface 48. As can be appreciated, centrifugal forces along an interface surface between the flats 46 and 48 will increase as the radius between the point S and the point of contact increases. The shortest radius would be at the point X. If a contact surface C between the flats 46 and 48 were formed on both sides of the point X, then there would be conflicting centrifugal force increases that would block the flow of lubricant past the point X. This is the main benefit of the chamfer 50. The chamfer 50 moves the initial contact point C to one point of the point X such that the entirety of the interface contact between the flats 46 and 48 is on one side of the contact point X, and such that the lubricant will be driven along the interface surface.

Figure 4:
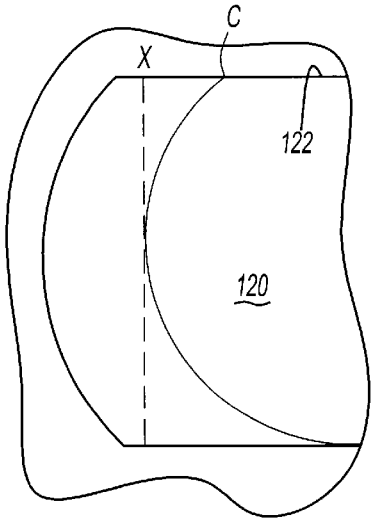
FIG. 4 shows another embodiment.

FIG. 4 shows another embodiment wherein the eccentric pin 120 is constructed such that it need not have a chamfer, but that instead its curve is such that the contact point C will occur to the same side of the extension point X as is the remainder of its flat surface 122.

Thus, it could be said the two embodiments of this invention not only have an oil lubricant notch, but further have structure to facilitate the lubricant being driven along the interface surfaces.

Figure 5:
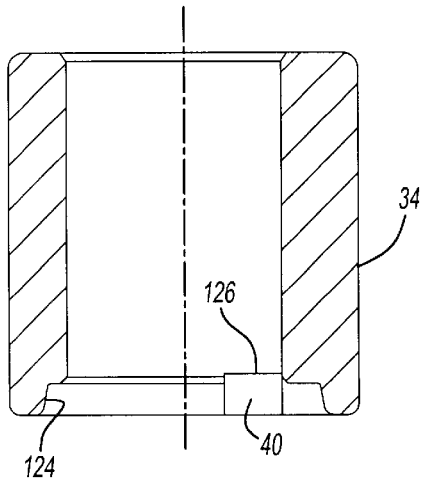
FIG. 5 shows a further feature of the inventive slider block.

FIG. 5 shows a further feature of the slider block 34 and its notch 40. As shown, a step 124 is typically formed in the bottom of the slider block 34. The notch has an upper surface 126 which extends vertically above this step.

The present invention thus provides a source of lubricant to the drive flat interface. The lubricant will be able to lubricate this interface, and thus improve operation of the scroll compressor.

A preferred embodiment of this invention has been disclosed, however a worker in this art would recognize that certain modifications would come within the scope of this invention. For that reason, the following claims should be studied to determine the true scope and content of this invention.

What is claimed is:

1. A scroll compressor comprising:

a first scroll member having a base and a generally spiral wrap extending from its base;

a second scroll member having a base and a generally spiral wrap extending from its base, said wraps of said first and second scroll members interfitting to define compression chambers;

a drive shaft driven to rotate, and to cause said second scroll member to orbit, said drive shaft including an eccentric pin extending upwardly into a bore in a slider block, said slider block being received within a boss extending downwardly from said second scroll member such that said eccentric pin moves with rotation of said shaft to cause said second scroll member to orbit relative to said first scroll member;

said eccentric pin and said slider block being engaged along an interface surface when rotation of said shaft is transmitted into orbiting movement of said second scroll member, and there being a port to deliver lubricant to said interface surface, said interface surface being designed to facilitate driving the lubricant from said port and along said interface surface, said interface surface being provided by a pair of generally flat surfaces; and said port extending through an entire width of said slider block from an inner peripheral surface defining said bore to an outer peripheral surface, and opening to a position circumferentially adjacent one end of said generally flat surface on said slider block.

2. A scroll compressor as recited in claim 1, wherein a chamfer surface is formed on said eccentric pin adjacent to its generally flat surface, said chamfer surface allowing said interface surface to drive the lubricant along said interface surface by ensuring that the entirety of said interface surface is on one side of an extension of a center point of said drive shaft drawn generally perpendicular to said interface surface.

3. A scroll compressor as recited in claim 2, wherein said chamfer is associated with an outlet of said port, such that lubricant delivered into said bore is adjacent said chamfer.

4. A scroll compressor comprising:

a first scroll member having a base and a generally spiral wrap extending from its base;

a second scroll member having a base and a generally spiral wrap extending from its base, said wraps of said first and second scroll members interfitting to define compression chambers;

a drive shaft driven to rotate, and to cause said second scroll member to orbit, said drive shaft including an eccentric pin extending upwardly into a bore in a slider block, said slider block being received within a boss extending downwardly from said second scroll member such that said eccentric pin moves with rotation of said shaft to cause said second scroll member to orbit relative to said first scroll member;

said eccentric pin and said slider block being engaged along an interface surface when rotation of said shaft is transmitted into orbiting movement of said second scroll member, and there being a port opening to a position circumferentially adjacent said interface surface to deliver lubricant to said interface surface, said interface surface being designed to facilitate driving the lubricant along said interface surface;

said interface between said eccentric pin and said slider block being provided by a pair of generally flat surfaces; and said slider block extends further from said second scroll member than docs said boss, and an end of said slider block remote from said second scroll member, and extending beyond said boss, includes said port.

5. A scroll compressor as recited in claim 4, wherein said port is formed by a notch in said end, said notch having an inlet communicating with a lubricant reservoir between a crankcase and said boss, and having an outlet communicating with said bore in said slider block.

6. A scroll compressor as recited in claim 4, wherein said port extends through an entire width of said slider block from an inner peripheral surface defining said bore to an outer peripheral surface.

7. A scroll compressor comprising:

a first scroll member having a base and a generally spiral wrap extending from its base;

a second scroll member having a base and a generally spiral wrap extending from its base, said wraps of said first and second scroll members interfitting to define compression chambers;

a drive shaft driven to rotate, and to cause said second scroll member to orbit, said drive shaft including an eccentric pin extending upwardly into a bore in a slider block, said slider block being received within a boss extending downwardly from said second scroll member such that said eccentric pin moves with rotation of said shaft to cause said second scroll member to orbit relative to said first scroll member;

said eccentric pin and said slider block being engaged along an interface surface when rotation of said shaft is transmitted into orbiting movement of said second scroll member, and there being a port to deliver lubricant to said interface surface, said interface surface being designed to facilitate driving the lubricant along said interface surface;

said interface between said eccentric pin and said slider block being provided by a pair of generally flat surfaces; and said eccentric pin is constructed such that the entirety of said interface surface is defined on one side of an extension of a center line of said drive shaft drawn perpendicular to said generally flat surface of said eccentric pin.

8. A scroll compressor comprising:

a first scroll member having a base in a generally spiral wrap extending from its base;

a second scroll member having a base in a generally spiral wrap extending from its base, said wraps of said first and second scroll members interfitting to define compression chambers;

a drive shaft driven to rotate, and to cause said second scroll member to orbit, said drive shaft including an eccentric pin extending upwardly into a bore in a slider block, said slider block being received within a boss extending downwardly from said second scroll member such that said eccentric pin moves with rotation of said shaft to cause said slider block and said second scroll member to orbit relative to said first scroll member, and said eccentric pin and said slider block being engaged along an interface surface when rotation of said shaft is transmitted into orbiting movement of said second scroll member, and there being a port to deliver lubricant to said interface surface, said interface surface being provided by a pair of generally flat surfaces, with one of said generally flat surfaces being provided with a chamfer adjacent an outlet side of said port.

9. A scroll compressor as recited in claim 8, wherein said slider block extends further from said second scroll member than does said boss and an end of said slider block remote from said second scroll member includes said port.

10. A scroll compressor as recited in claim 9, wherein said port is formed by a notch in said end, said notch having an inlet communicating with a lubricant reservoir between a crankcase which supports said second scroll member and said boss, said port having an outlet communicating with said bore in said slider block.

11. A scroll compressor as recited in claim 8, wherein said chamfer is formed on said eccentric pin.

12. A scroll compressor as recited in claim 11, wherein said chamfer is positioned adjacent an outlet end of said port such that lubricant delivered into said bore collects in a reservoir formed by said chamfer.

13. A scroll compressor as recited in claim 8, wherein said chamfer is defined on said eccentric pin, and an extension of a center line of said drive shaft drawn perpendicular to said flat surface on said eccentric pin is positioned such that the entirety of said interface surface is on one side of said extension due to said chamfer.

* * * * *

UNITED STATES PATENT AND TRADEMARK OFFICE

CERTIFICATE OF CORRECTION

PATENT NO. : 6,471,499 B1
DATED : October 29, 2002
INVENTOR(S) : Sun

It is certified that error appears in the above-identified patent and that said Letters Patent is hereby corrected as shown below:

Column 4,
Line 30, “docs” should be -- does --;

Signed and Sealed this

Twenty-sixth Day of August, 2003

JAMES E. ROGAN
*Director of the United States Patent and Trademark Office*